US005598254A

United States Patent [19]

Ikesue et al.

[11] Patent Number: 5,598,254

[45] Date of Patent: Jan. 28, 1997

[54] CARTRIDGE FOR REPLENISHING TWO-INGREDIENT DEVELOPER TO AN IMAGE FORMING APPARATUS AND A REPLENISHING DEVICE USING THE SAME

[75] Inventors: Masumi Ikesue, Tokyo; Tsukuru Kai, Fujisawa; Hidetoshi Yano, Yokohama; Nobuto Yokokawa, Gotenba, all of Japan

[73] Assignee: Ricoh Company, Ltd., Tokyo, Japan

[21] Appl. No.: 521,324

[22] Filed: Aug. 30, 1995

[30] Foreign Application Priority Data

| | | | |
|---|---|---|---|
| Aug. 31, 1994 | [JP] | Japan | 6-207632 |
| Oct. 20, 1994 | [JP] | Japan | 6-255629 |
| Nov. 4, 1994 | [JP] | Japan | 6-271312 |
| Nov. 4, 1994 | [JP] | Japan | 6-271314 |
| Jul. 6, 1995 | [JP] | Japan | 7-171157 |

[51] Int. Cl.[6] ..... G03G 15/06

[52] U.S. Cl. ..... 399/262; 222/129; 222/DIG. 1; 399/358

[58] Field of Search ..... 355/260, 245, 355/298, 246; 222/129, 43, 94, DIG. 1, 325; 118/653

[56] References Cited

U.S. PATENT DOCUMENTS

| | | | |
|---|---|---|---|
| 3,443,726 | 5/1969 | Muller et al. | 222/129 X |
| 4,611,730 | 9/1986 | Ikesue et al. | 222/DIG. 1 X |
| 4,641,945 | 2/1987 | Ikesue et al. | 222/DIG. 1 X |
| 4,696,255 | 9/1987 | Yano et al. | 118/653 |
| 4,700,659 | 10/1987 | Hirakura et al. | 355/253 X |
| 4,744,493 | 5/1988 | Ikesue et al. | 222/DIG. 1 X |
| 4,760,422 | 7/1988 | Seimiya et al. | 118/653 X |
| 4,878,603 | 11/1989 | Ikesue et al. | 222/DIG. 1 X |
| 4,930,438 | 6/1990 | Demizu et al. | 118/653 X |
| 5,109,254 | 4/1992 | Oka et al. | 222/DIG. 1 X |
| 5,280,324 | 1/1994 | Ono et al. | 355/260 |
| 5,416,568 | 5/1995 | Yoshiki et al. | 355/245 X |
| 5,450,178 | 9/1995 | Kawashima et al. | 355/260 |
| 5,502,552 | 3/1996 | Ikesue et al. | 355/245 X |
| 5,508,794 | 4/1996 | Ikesue et al. | 355/260 |

FOREIGN PATENT DOCUMENTS

| | | |
|---|---|---|
| 2-244174 | 9/1990 | Japan . |
| 6-43755 | 2/1994 | Japan . |
| 6-258943 | 9/1994 | Japan . |

*Primary Examiner*—Shuk Yin Lee

*Attorney, Agent, or Firm*—Oblon, Spivak, McClelland, Maier & Neustadt, P.C.

[57] ABSTRACT

A cartridge for replenishing a two-ingredient developer to an image forming apparatus, and a developer replenishing device using it are disclosed. The cartridge is made up of two containers each storing a content of particular kind. One of the containers has an annular portion and a bore formed at the center by the annular portion. The other container has a cylindrical configuration and coaxially mates with the above container to form a single unit. Coaxial openings are respectively formed in the containers. Spiral grooves inclined in opposite directions to each other are respectively formed on the inner peripheries of the containers.

8 Claims, 18 Drawing Sheets

CARTRIDGE FOR REPLENISHING TWO-INGREDIENT DEVELOPER TO AN IMAGE FORMING APPARATUS AND A REPLENISHING DEVICE USING THE SAME

BACKGROUND OF THE INVENTION

The present invention relates to an electrophotographic copier, facsimile apparatus, laser printer or similar image forming apparatus and, more particularly, to a cartridge for replenishing a two-ingredient developer to an image forming apparatus, and a replenishing device using the same.

A two-ingredient developer, i.e., a mixture of chargeable carrier particles and chargeable toner particles is extensively used with an image forming apparatus of the kind described. The toner particles deposit on the carrier particles due to frictional charge. When development is repeated with this type of developer, the toner particles are sequentially consumed with the result that the toner concentration and, therefore, image density is sequentially lowered. It has been customary to replenish fresh toner to the developer in an amount corresponding to the consumed toner. On the other hand, the carrier particles have their surfaces covered with a substance for enhancing the frictional charging characteristic. The problem with the carrier is, for example, that the above substance sequentially comes off due to the repeated development and thereby deteriorates the carrier.

In light of the above, Japanese Patent Laid-Open Publication No. 53-22747. for example, teaches a system capable of replenishing a fresh two-ingredient developer to a developing unit while discharging a used developer from the unit, thereby replacing the carrier. In addition, this system is capable of replenishing fresh toner independently of the developer in order to control the toner concentration and to thereby maintain an expected developing ability. For this purpose, the system has exclusive mechanisms for replenishing the developer and the toner, respectively. These mechanisms each include an exclusive container storing the developer or the toner. However, this kind of scheme brings about another problem that the independent containers, each needing an exclusive space, increase the overall size of the developing unit and, therefore, that of the image forming apparatus. In addition, the independent containers limit the design freedom of the image forming apparatus.

Moreover, assume that the containers are laid sideways in order to supply the developer and the toner from the respective containers to the range of the developing unit where a developer exists, as proposed in, for example, Japanese Patent Laid-Open Publication Nos. 59-188671, 60-146265, and 62-6285. Then, the independent containers should be each driven by a respective drive and transmission mechanism, resulting in an increase in the number of parts.

SUMMARY OF THE INVENTION

It is, therefore, an object of the present invention to provide a cartridge for replenishing a two-ingredient developer, and capable of saving space and simplifying drive arrangements.

It is another object of the present invention to provide a replenishing device using the above cartridge, and having simple arrangements for supply and collection, and realizing sure supply and collection.

In accordance with the present invention, in a cartridge having two containers constructed into a single assembly and each storing a content of particular kind, one of the containers coaxial with the other container is fitted in a bore formed at the center of the other container by an annular portion. The containers have respective openings positioned at the same side and coaxial with each other.

Also, in accordance with the present invention, in a cartridge having a first container and a second container having the same diameter and each storing a content of particular kind, the first container has a recess formed in the bottom, a first spiral ridge formed on the inner periphery, and a first opening formed in one end. The second container has a projection formed in the bottom and mating with the recess of the first container, a second spiral ridge formed on the inner periphery and inclined in the same direction as the first spiral ridge, and a second opening formed in one end remote from the above end of the first container and coaxial with the first opening.

Further, in accordance with the present invention, a device for replenishing a developer into a developing unit has a cartridge having two containers constructed into a single assembly and each storing a content of particular kind. One of the containers coaxial with the other container is fitted in a bore formed at the center of the other container by an annular portion. The containers have respective openings positioned at the same side and coaxial with each other. A single supply device guides and conveys each of the contents discharged from the openings of the containers to the developing unit. A collection device collects substances overflowing the developing unit in at least one of the two containers.

Moreover, in accordance with the present invention, a device for replenishing a developer into a developing unit has a cartridge having two containers constructed into a single assembly and each storing a content of particular kind. One of the containers coaxial with the other container is fitted in a bore formed at the center of the other container by an annular portion. The containers have respective openings positioned at the same side and coaxial with each other. A conveying member has inlets each for receiving one of the contents discharged from the two containers at a particular position.

In addition, in accordance with the present invention, a device for replenishing a developer into a developing unit has a cartridge having two containers constructed into a single assembly and each storing a content of particular kind. One of the containers coaxial with the other container is fitted in a bore formed at the center of the other container by an annular portion. The containers have respective openings positioned at the same side and coaxial with each other. A chuck member selectively opens or closes the single lid such that the lid is pulled out in two consecutive steps in order to uncover the openings of the containers stepwise.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
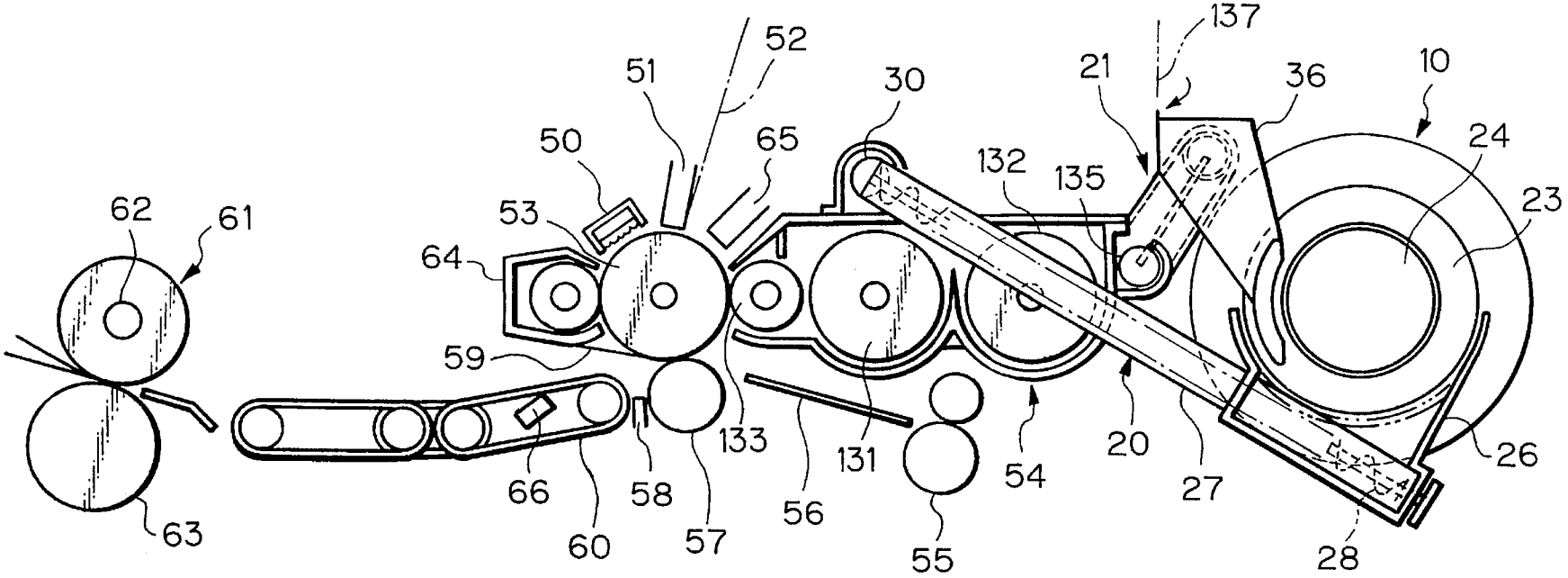
FIG. 1 is a section showing the general construction of an image forming apparatus or engine on which a developer replenishing device embodying the present invention is mounted.

Referring to FIG. 1 of the drawings, there is shown an image forming engine having a developing unit connected to a developer replenishing device embodying the present invention. Basically, the general construction of the engine is conventional. Specifically, a main charger 50 uniformly charges the surface of a photoconductive drum 53. Imagewise light 51 from a slit (for analog image formation) or a laser beam 52 (for digital image formation) forms a latent image on the charged surface of the drum 53. A developing unit 54 develops the latent image to produce a corresponding toner image. A paper is fed toward the drum 53 via a registration roller 55 along a guide 56 in such a manner as to meet the toner image formed on the drum 53. An image transfer unit 57 transfers the toner image from the drum 53 to the paper. A discharge brush 58 discharges the paper to allow it to be stably conveyed. When the separation of the paper from the drum 53 is incomplete, a separator 59 positively separates the former from the latter. A belt 60 conveys the separated paper to a fixing unit 61 having a heater 62 and a press roller 63. The heater 62 and press roller 63 cooperate to fix the toner image on the paper by applying heat and pressure thereto. After the image transfer, the toner remaining on the drum 53 is collected by a cleaning unit 64, so that the drum 53 is prepared for the next image formation. An eraser 65 is interposed between the exposure position and the developing unit 54. The eraser 65 selectively erases the charge of the drum 53 in order to prevent the toner from depositing on the unnecessary portions of the drum 53. A paper sensor 66 is associated with the belt 60 and responsive to the separation of the paper from the drum 53 at the image transfer position. The paper sensor 66 is used to prevent the paper from jamming the path or from wrapping around the drum 53.

Figure 2A:
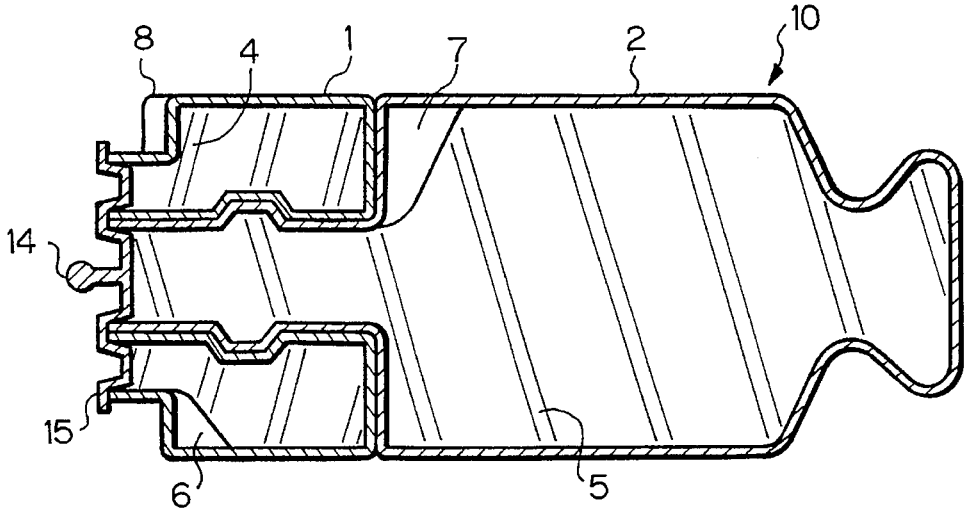
FIG. 2A is a section showing a cartridge embodying the present invention in an assembled condition.
Figure 2B:
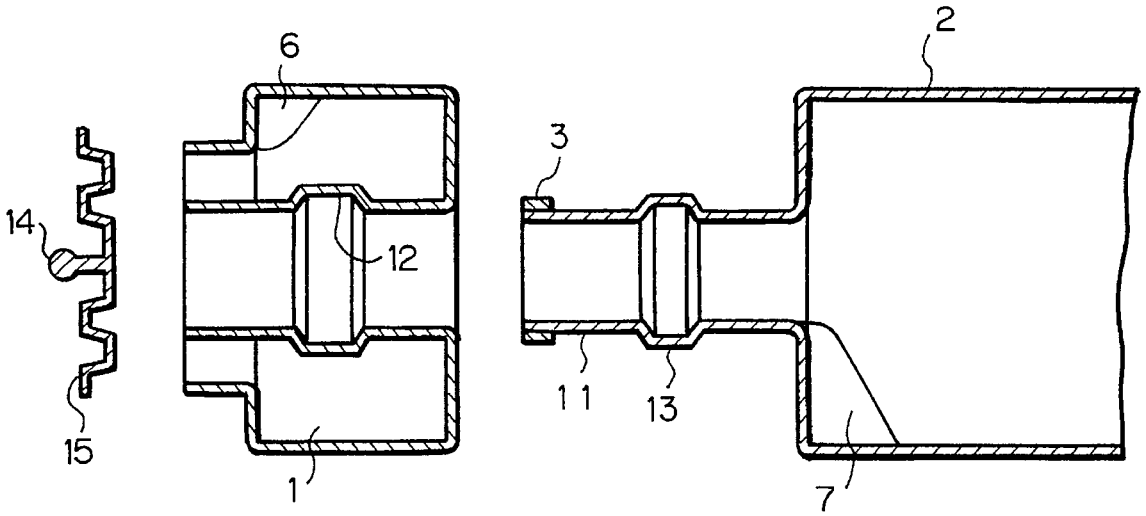
FIG. 2B is an exploded view showing the cartridge in a condition before assembly.

A cartridge assembly, or simply cartridge as referred to hereinafter, 10 is communicated to the developing unit 54 by a supply device 20 and an exhaust device 21. As shown in FIG. 2A, the cartridge 10 is made up of a first container 1 storing a developer, and a second container 2 storing toner and coaxial with the container 1. The container 1 and 2 are constructed into a unit by being mated with each other. The container 1 is generally implemented as a hollow cylinder having two concentric walls. As shown in FIG. 2B in an exploded view, the container 2 has a larger diameter portion storing the toner therein, and a smaller diameter portion or projection 11 firmly fitted in a through bore formed at the center of the container 1. The container 1 has an annular recess 12 while the container 2 has an annular ridge 13. The ridge 13 is received in the recess 12 to prevent the containers 1 and 2 from being easily separated from each other. A seal member 3 is adhered to the entire circumference of the open end of the projection 11 in order to hermetically isolate the containers 1 and 2 from each other. The recess 12 and ridge 13 are only illustrative and may be replaced with a dimensional implementation capable of insuring the tight engagement of the containers 1 and 2.

Figure 3A:
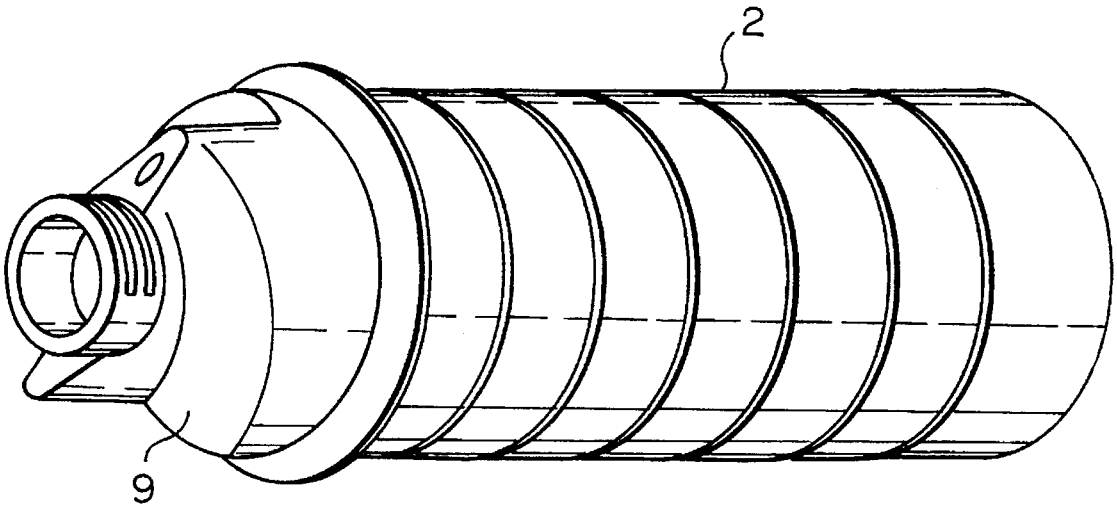
FIG. 3A is an external perspective view of a second container included in the cartridge and storing toner.
Figure 3B:
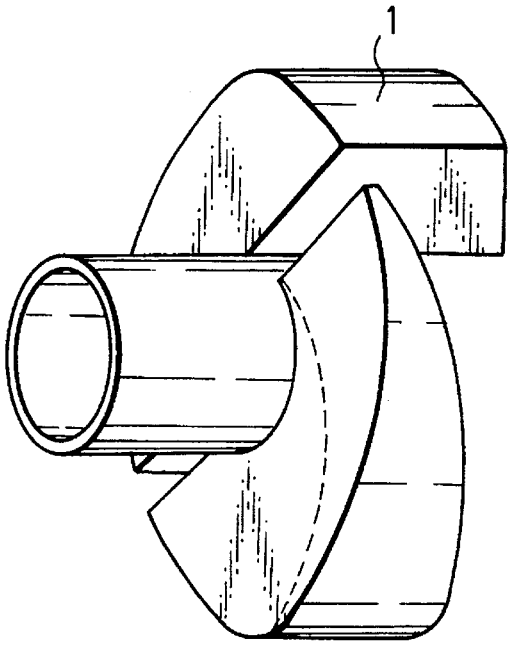
FIG. 3B is an external perspective view of a first container also included in the cartridge and storing a developer.

Another specific configuration for coupling the containers 1 and 2 is as follows. As shown in FIG. 3A, the container 2 assigned to the toner is formed with a tapered shoulder portion 9 around its opening or toner outlet. As shown in FIG. 3B, the container 1 storing the developer has its end configured complementarily to the shoulder portion 9 of the container 1. In this case, the container 1 is fitted to the container 2 by being turned.

Figure 2C:
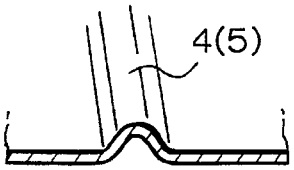
FIG. 2C is a fragmentary enlarged section showing a spiral ridge included in the cartridge.

Referring again to FIG. 2A, the containers 1 and 2 are rotatable integrally and coaxially with each other. Spiral ridges 4 and 5 are respectively formed on the inner peripheries of the containers 1 and 2, and each protrudes radially inward. As shown in FIG. 2C specifically, the ridges 4 and 5 may be implemented as undulations formed in the walls of the containers 1 and 2. The ridges 4 and 5 should each be high enough to exert a conveying force on the toner or the developer in a predetermined direction when the cartridge is rotated. The ridges 4 and 5 extend spirally in opposite directions to each other, i.e., they are inclined in opposite directions to each other. Hence, when the cartridge is rotated in one direction, the developer, for example, in the container 1 is conveyed toward the opening of the container 1, i.e., to the left as viewed in FIG. 2A, while the toner in the container 2 is conveyed away from the opening of the container 2. When the cartridge is rotated in the other direction, the toner is conveyed toward the opening of the container 2, or to the left in FIG. 2A, while the developer is conveyed away from the opening of the container 1.

The containers 1 and 2 are respectively formed with guide walls 6 and 7 at their portions where the larger diameter portions merge into the smaller diameter portions, i.e., shoulder portions. The guide walls 6 and 7 each has a configuration matching the flow of the developer or the toner caused by the spiral ridge 4 or 5, thereby insuring the discharge of the developer or the toner. The container 1 has an extension 8 at its front end. When the cartridge is to be bodily rotated by a drive source included in the engine, a torque is applied to the containers 1 and 2 via the extension 8. In the illustrative embodiment, the container 2 has a constricted portion at its rear end in order to facilitate the mounting of the cartridge to the engine, although it is not essential.

As shown in FIGS. 2A and 2B, a single lid 15 closes both of the openings of the containers 1 and 2 and has a thumb piece 14. The single lid 15, contributing to the decrease in the number of parts, is removed from the cartridge when the cartridge is mounted to the developing unit. The lid 15 may be removed by hand or by an automatic chuck 16 shown in FIG. 4B. The chuck 16 chucks the thumb piece 14 and then removes the lid 15 in the direction indicated by an arrow in FIG. 4B.

Figure 4A:
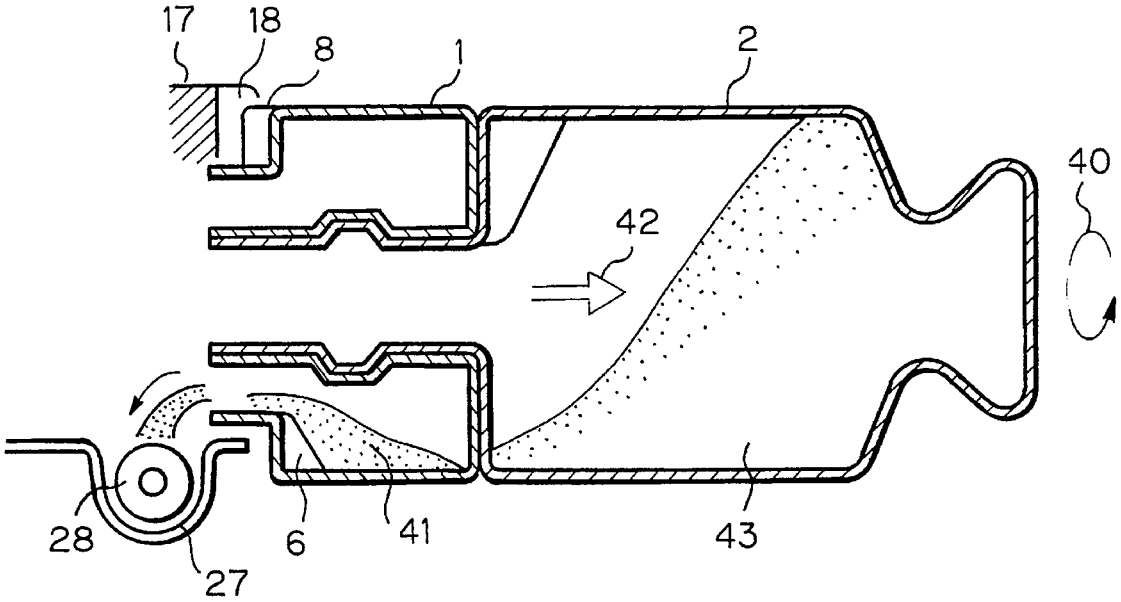
FIG. 4A is a section demonstrating how the developer is replenished from the cartridge shown in FIG. 2A.
Figure 4B:
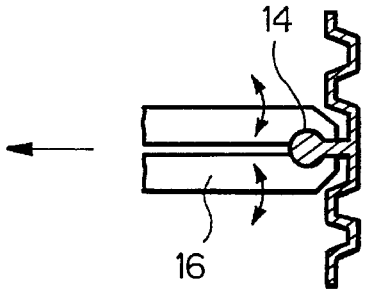
FIG. 4B is a section showing how a lid is removed from the cartridge before replenishment.

Assume that the lid 15 has been removed, and the developer should be replenished from the cartridge. Then, as shown in FIG. 4A, the cartridge is rotated by a drive device 17, included in the engine, in the direction indicated by an arrow 40 via the extension 8 mating with a groove 18 which is formed in the drive device 17. As a result, the developer, labeled 41, stored in the container 1 is driven out onto a conveyor screw 28 over the guide wall 6. The screw 28 is received in a pipe 27 and rotated to convey the developer 41 along the pipe 27. As shown in FIG. 1, the developer flowing out via the opening of the container 1, i.e., a first outlet 23 of the cartridge 10 drops into the pipe 27 while being prevented from flying about by a supply guide 26. The screw 28 in the pipe 27 conveys the developer into the developing unit 54 via an inlet 30 formed in the top cover portion of the unit 54. Of course, the developer may be directly replenished into the unit 54 without the intermediary of the screw 28 or the pipe 27, depending on the mounting position of the cartridge 10.

As shown in FIG. 4A, while the developer is replenished as stated above, the toner, labeled 43, of the container 2 is conveyed by the spiral ridge 5 in a direction indicated by an outline arrow 42. As a result, the toner 43 is prevented from flowing out of the container 2, and in addition it is agitated and prevented from forming blocks.

Figure 5:
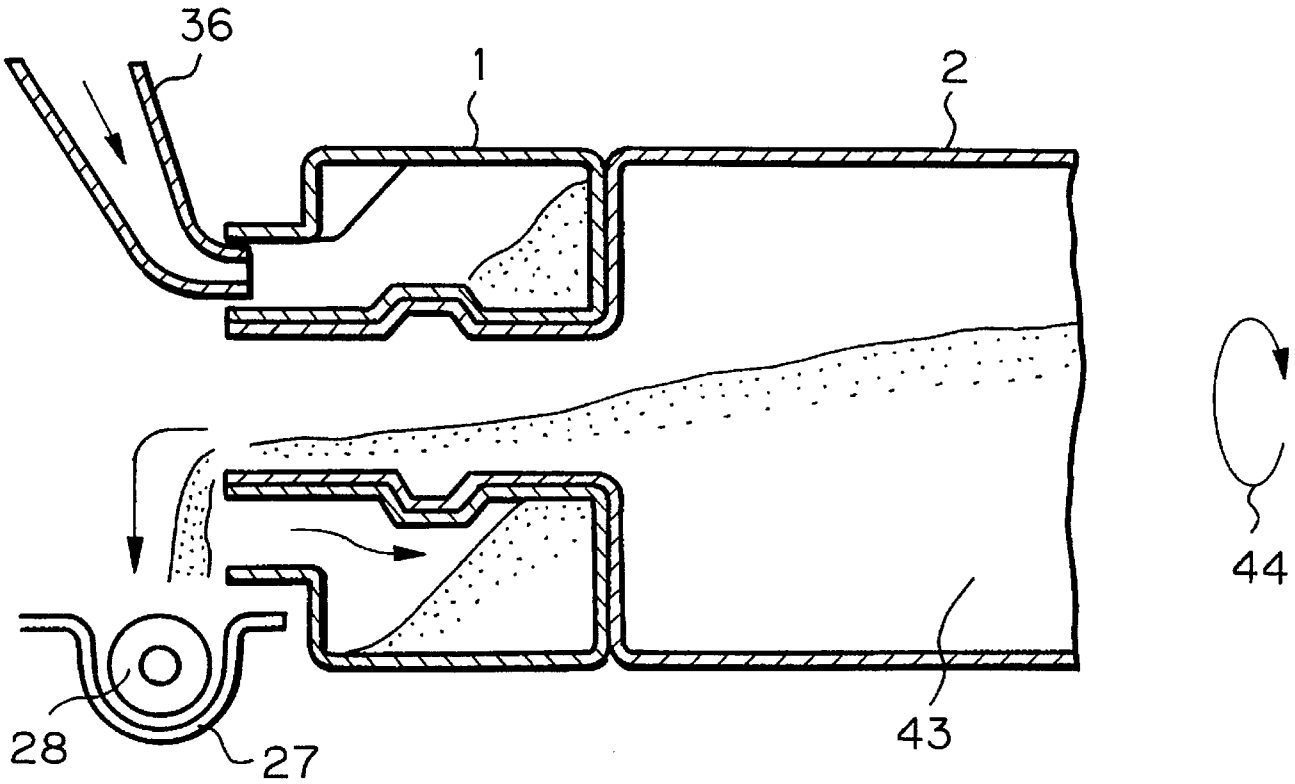
FIG. 5 shows a procedure for discharging the toner from the second container while collecting a used developer.

The toner 43 is replenished for the adjustment of the toner concentration, as follows. The cartridge is rotated in the other direction, i.e., the direction indicated by an arrow 44 in FIG. 5. As a result, the toner 43 is driven out of the container 2 by the spiral ridge 5 over the guide wall 7. As shown in FIG. 1, the toner flowing out of the opening of the container 2, i.e., a second outlet 24 of the cartridge 10 drops into the pipe 27 while being prevented from flying about by the supply guide 26. The screw 28 received in the pipe 27 conveys the toner into the developing unit 54 via the inlet 30. At this instant, the developer is prevented from flowing out of the container 1 by the spiral ridge 4. After the discharge of the developer and the replenishment of the toner, the developer overflowing the developing unit 54 is collected. Specifically, a collection guide 36 is set at the opening of the container 1, and then the cartridge is bodily rotated in the direction 44, FIG. 5. As a result, the developer overflowing the developing unit 54 is collected in the container 1 via the collection guide 36.

Figure 6:
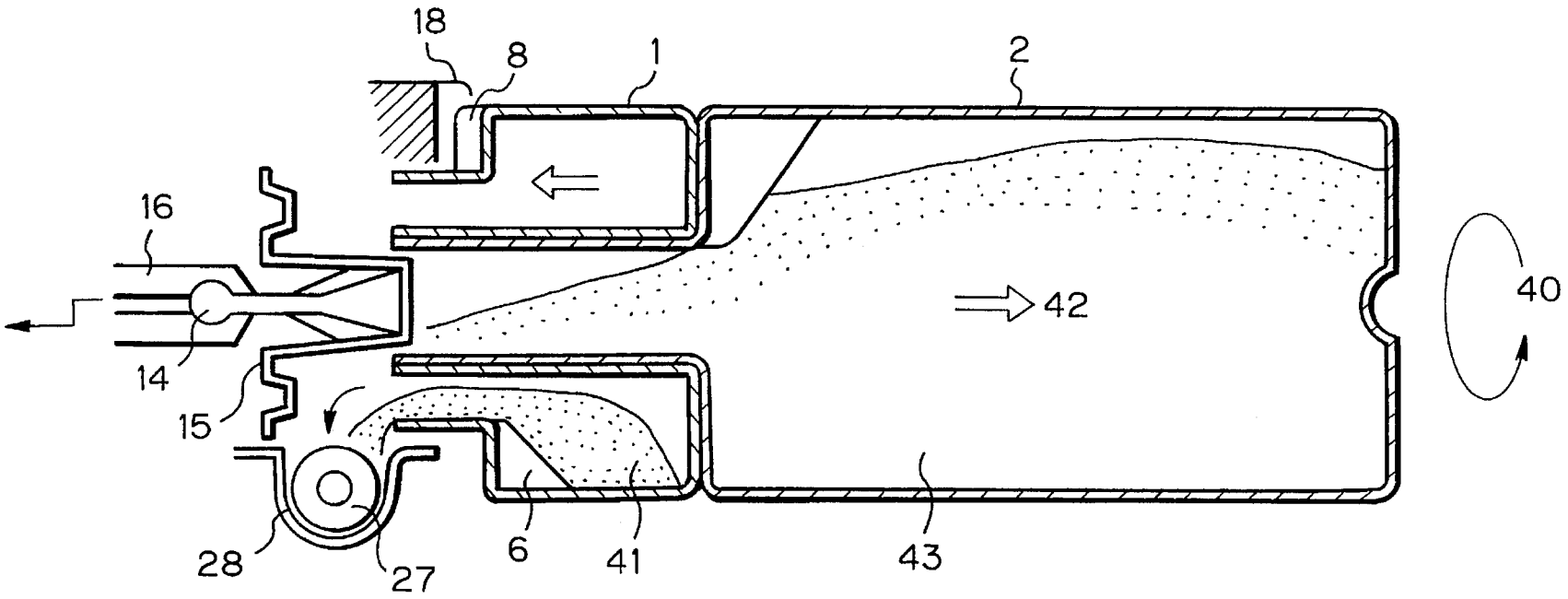
FIG. 6 is a section showing how the cartridge, provided with an improved lid, replenishes the developer.

In the above arrangement, the developer is supplied to the developing unit 54 from the container 1, and then the toner is supplied from the container 2. Alternatively, the cartridge may be rotated in opposite directions for a predetermined period of time each, in which case the developer and toner will be mixed in the pipe 27 beforehand and then supplied to the developing device 54 together. When the developer and toner are sequentially supplied in this order, the lid 15 may be configured to protrude into each of the containers 1 and 2 to a particular depth. For example, the lid 15 may protrude deeper into the container 2 than into the container 1. Then, when the lid 15 is pulled out, the opening of the container 1 and that of the container 2 will be sequentially uncovered in this order. The prerequisite with this configuration is that, as shown in FIG. 6, when the chuck 16 pulls out the lid 15 in the direction indicated by an arrow at the beginning of the replenishment of the developer, the part of the lid 15 corresponding to the container 2 maintains the opening of the container 2 closed. In this condition, after the extension 8 of the cartridge has been engaged with the drive groove 18, the cartridge is rotated in the direction 40. As a result, the developer 41 is driven out of the container 1 onto the screw 28 over the guide wall 6.

Even when the cartridge shakes itself and the fluidity of the toner is high, e.g., just after the replacement of the cartridge, the lid 15 covers the opening of the container 2 at the time of the replenishment of the developer and thereby prevents the toner 43 from being driven out of the container 2. At the time of replenishment of the developer, the spiral ridge 5 of the container 2 exerts a conveying force on the toner 43 in the direction 42. At the same time, the toner 43 is agitated and prevented from forming blocks in the container 2.

Figure 7:
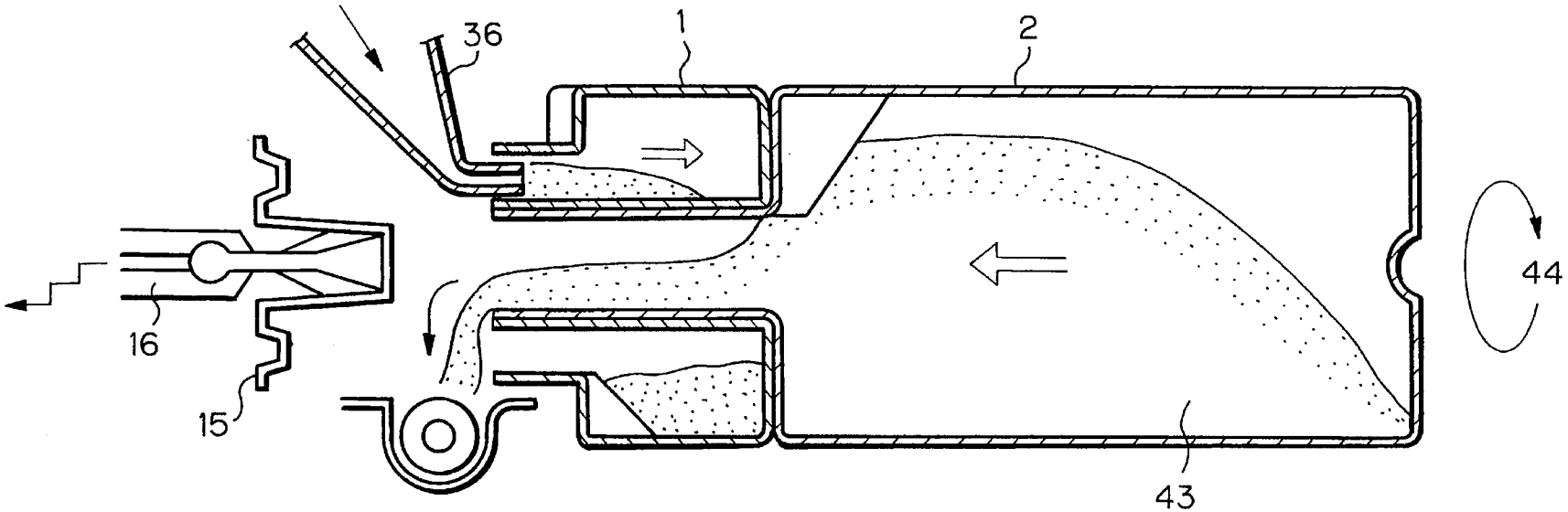
FIG. 7 is a section showing how the cartridge of FIG. 7 replenishes the toner and collects the used developer.

When the cartridge is rotated for a sufficient period of time in the direction 40, it is determined that the replenishment of the developer has completed. Then, the fresh toner 43 begins to be replenished in order to adjust the toner concentration. At this time, the cartridge is rotated in the other direction, as indicated by an arrow 44 in FIG. 7. At the same time, automatic chuck 16 pulls out the lid 15 further so as to uncover the opening of the container 2. Consequently, the toner 43 is driven out of the container 2 by the spiral ridge 5. On the other hand, the collection guide or conduit 36 is communicated to the opening of the container 1 which is now empty. As a result, the used developer is collected in the container 1 via the conduit 36. The conduit 36 is moved by a drive device, not shown, and is retracted to a position not interfering with the lid 15 in the event when the lid 15 is moved toward and away from the cartridge.

Figure 8:
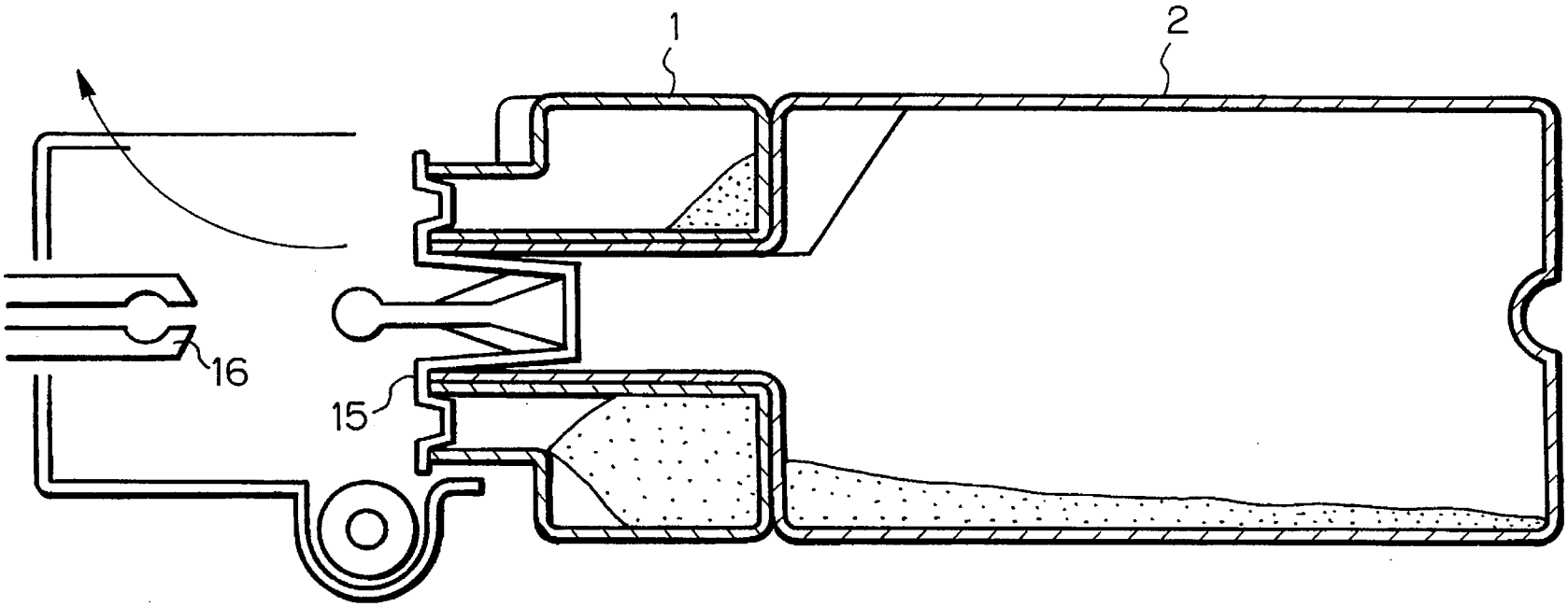
FIG. 8 is a section showing the cartridge of FIG. 6 in a waiting state to occur in a toner end condition.

When a predetermined amount of used developer is collected in the cartridge, the cartridge is replaced with a new cartridge. At this instant, as shown in FIG. 8, the container 1 is filled with the used developer while the container 2 is substantially empty. The chuck 16 pushes the lid 15 into the openings of the containers 1 and 2 and then returns to its original position. In this condition, the cartridge waits for replacement.

Figure 9:
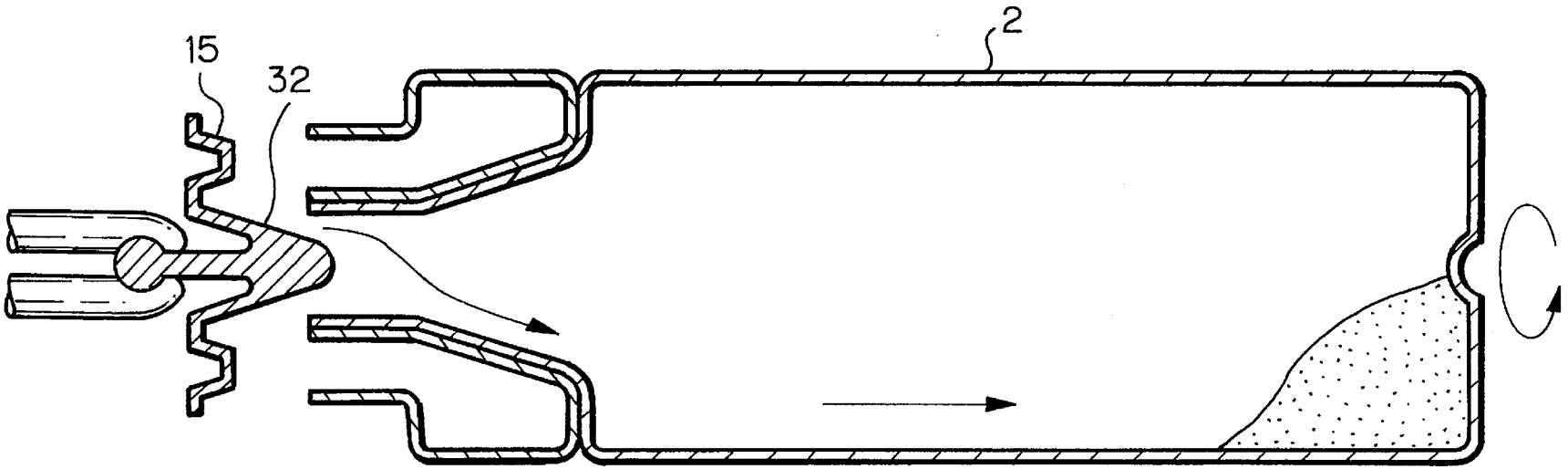
FIG. 9 is a section showing how the cartridge, provided with an improved lid and an improved configuration for connecting the two containers, collects the used developer.
Figure 10:
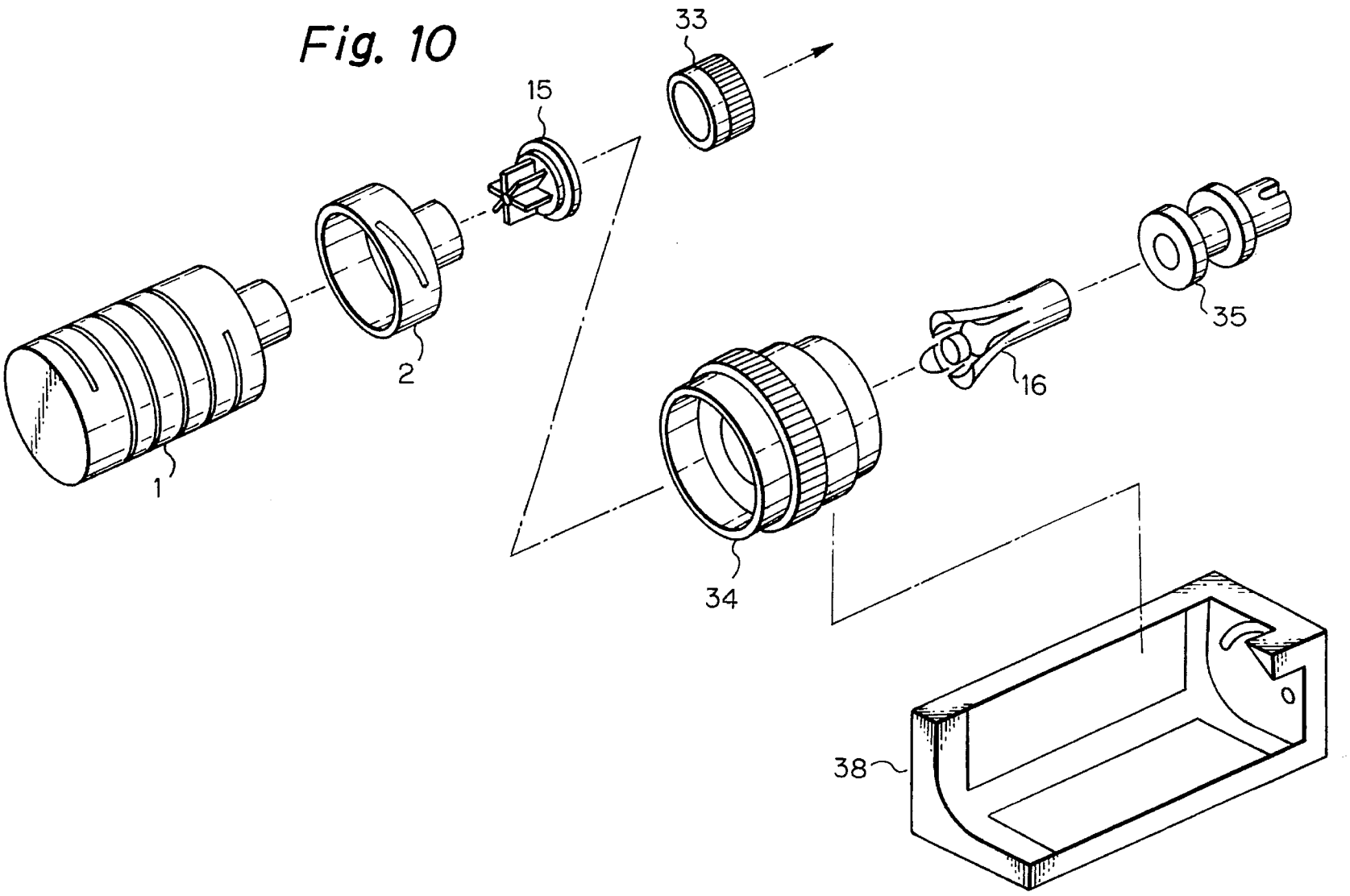
FIG. 10 is an exploded view showing how the cartridge of FIG. 9 is mounted to a developing unit together with a predevelopment tank.
Figure 11:
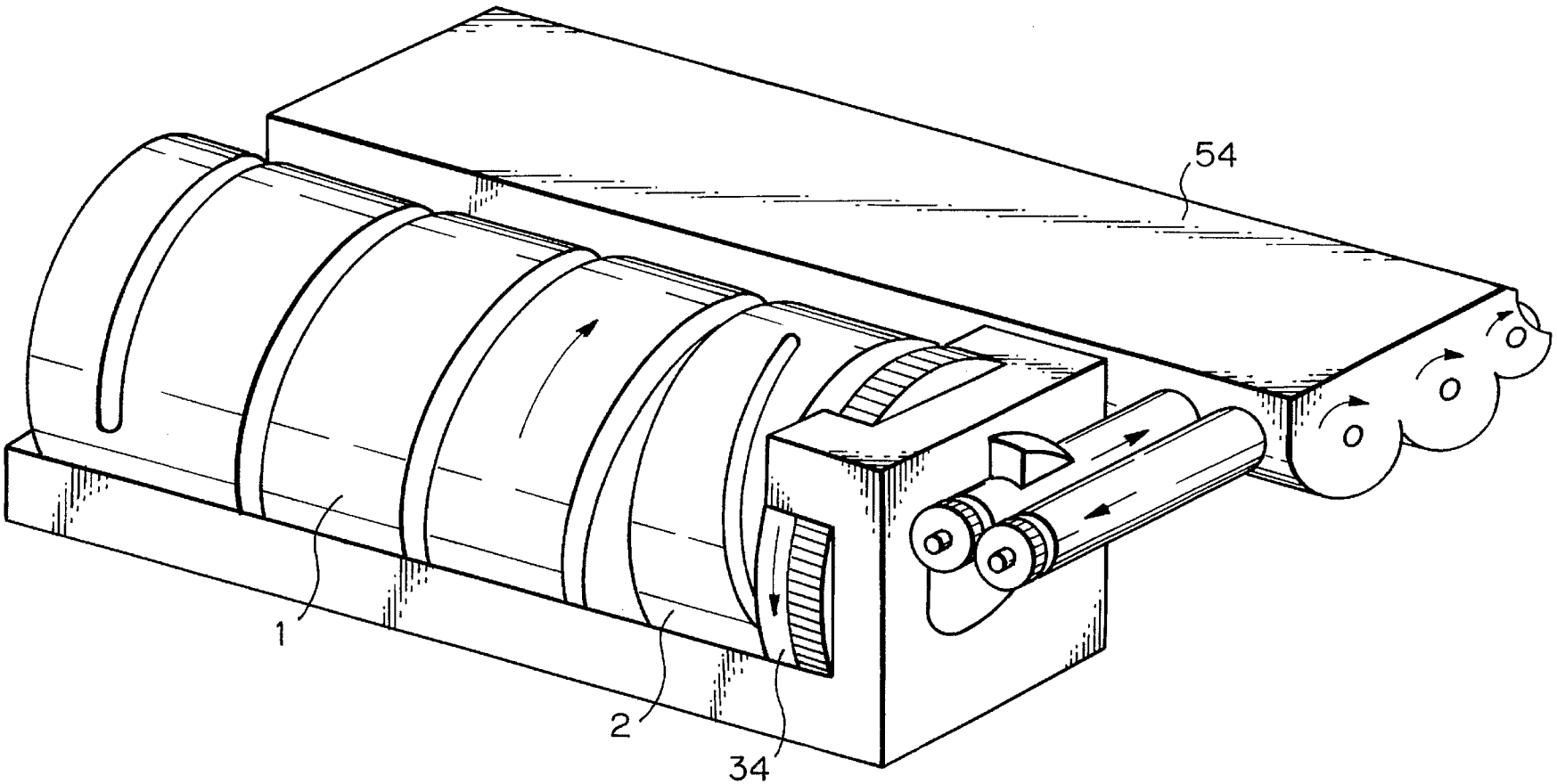
FIG. 11 is an external perspective view showing the cartridge of FIG. 9 mounted to the developing unit together with the predevelopment tank.

To simplify the arrangement, the used developer may be collected in the cartridge by use of the portion of the lid 15 to be inserted into the container 2, as shown in FIG. 9. As shown, the lid 15 is tapered at its portion 32 to be inserted into the container 2. The tapered portion 32 guides the used developer into the exhausted container 2, and then the spiral ridge 5 drives it toward the rear end of the container 2. How the cartridge with the lid 15 having the tapered portion 32 is mounted to a cartridge mount will be described with reference to FIG. 10. As shown, the cartridge made up of the containers 1 and 2 and lid 15 has its cap 33 removed before being mounted to a cartridge mount 38. Then, the cartridge is set in one end of a predevelopment tank 34. The automatic chuck 16 is guided by a chuck guide 35 and disposed in the other end of the predevelopment tank 34 to push and pull the lid 15. If desired, the tapered portion 32 of the lid 15 may be provided with a rib-like configuration in order to prevent the used developer from dropping during collection. The cartridge is mounted to the mount 38 together with the tank 34. As shown in FIG. 11, the cartridge is rotated to replenish the developer and toner into the developing device 54 and to collect the used developer.

Figure 12A:
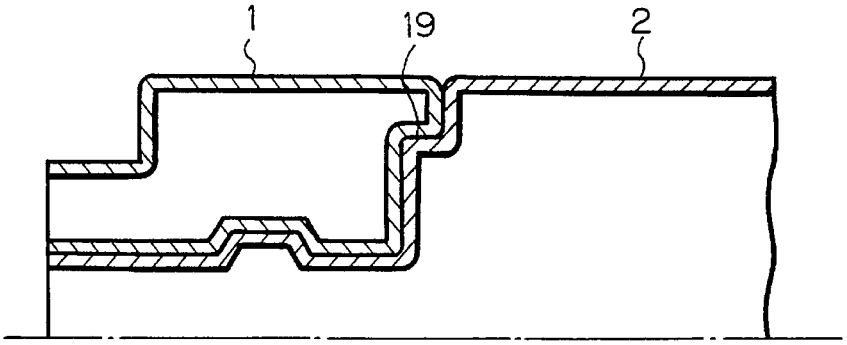
FIGS. 12A–12C are sections each showing another specific configuration of the containers.

As shown in FIG. 12A, the rear end of the container 1 and the front end of the peripheral portion of the container 2 may be formed with lugs and recesses 19 for mating with each other, so that the cartridge can be bodily rotated. The lugs and recesses 19 may be of any suitable shape, e.g., equilateral polygon so long as it insures the engagement of the containers 1 and 2. Further, the lugs and recesses 19 should only be suitably distributed in the circumferential direction; even only one lug and only one recess will suffice.

Figure 12B:
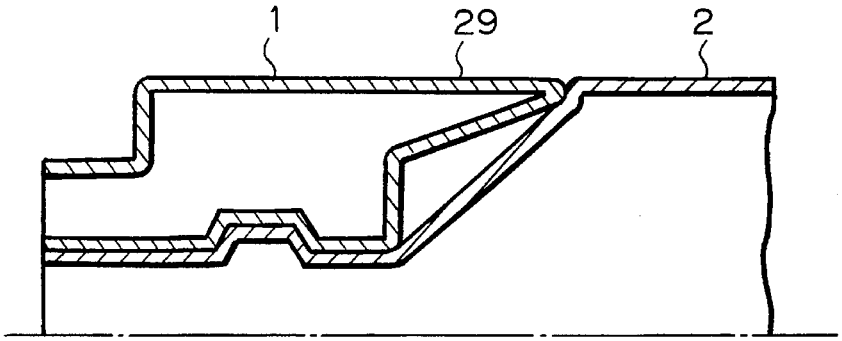

As shown in FIG. 12B, the container 1 may be provided with an annular extension 29 at its rear end. With the extension 29, the container 1 appears to merge into the container 2 smoothly. This successfully frees the operator from uneasy feelings and misorientation when the capacities of the containers 1 and 2 are changed. If the entire cartridge is provided with the above dimensions or appearance, it can be mounted to the developing unit 54 in the same way at all times.

Figure 12C:
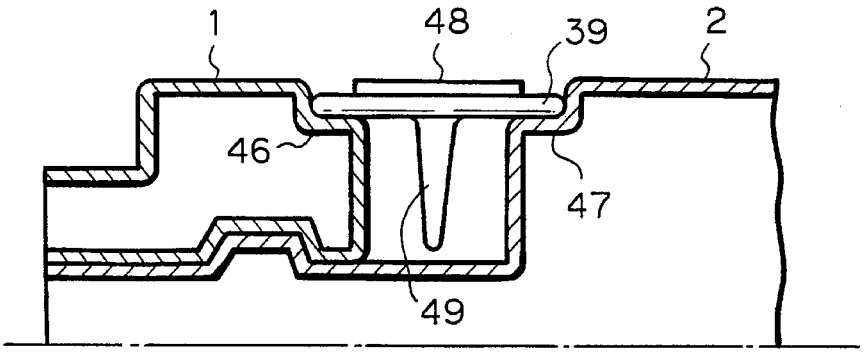

Assume that the outside diameters of the containers 1 and 2 and the length of the entire cartridge are the same as in the above specific configuration, but the capacities of the containers 1 and 2 are changed. Then, as shown in FIG. 12C, the resulting gap between the containers 1 and 2 may be closed by a spacer 39. Specifically, the spacer 39 is engaged with a shoulder 46 formed at the rear end of the container 1 and a shoulder 47 formed at the front end of the container 2, thereby connecting the outer peripheries of the containers 1 and 2 smoothly. A label 48, indicating instructions relating to the storage and replacement of the cartridge, may be adhered to the front of the spacer 39. When the gap between the containers 1 and 2 is relatively great, a rib 49 may be provided on the rear of the spacer 39. The rib 49 will enhance the mechanical strength of the spacer 39 and will thereby prevent the cartridge from yielding in the event of replacement or the like.

Figure 13:
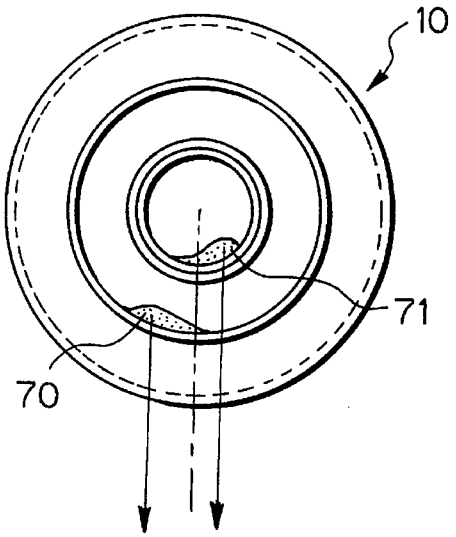
FIG. 13 demonstrates the discharge of the contents of the containers.

When the lid 15 protrudes into the containers 1 and 2 to different depths, as stated earlier, the lid 15 is slightly pulled out to uncover the opening of the container 1 and then further pulled out to uncover the opening of the container 2. This successfully prevents the toner from flowing out and being mixed with the developer in the event of replenishment of the developer. By contrast, when the lid 15 protrudes into the containers 1 and 2 to the same depth, it is likely that the toner and developer are mixed together despite the operation of the spiral ridges 4 and 5, increasing the toner concentration of the developer to an unexpected degree. This is particularly true when the toner and developer are each filled in the respective container in a high ratio. The mixture of the toner and developer will be further aggravated when a new cartridge is shaken in the event of replacement in order to loosen its contents. In light of this, not only the configuration of the lid 15 but also the configuration of the member for conveying the developer and toner may be improved, as follows. In the illustrative embodiment, the radial dimensions of the openings of the containers 1 and 2 are different from each other. In addition, the toner and developer each drops from the respective container 1 or 2 at a position deviated in the direction of rotation from a vertical extending through the axis of the container due to friction acting between it and the container. As a result, the toner and developer drop at positions noticeably deviated from each other. Specifically, as shown in FIG. 13, when the cartridge is rotated clockwise, the developer in the container 1 drops at a position 70 due to the functions of the ridge 4 and guide wall 6. When the cartridge is rotated counterclockwise, the toner in the container 2 drops at a position 71.

Figure 14A:
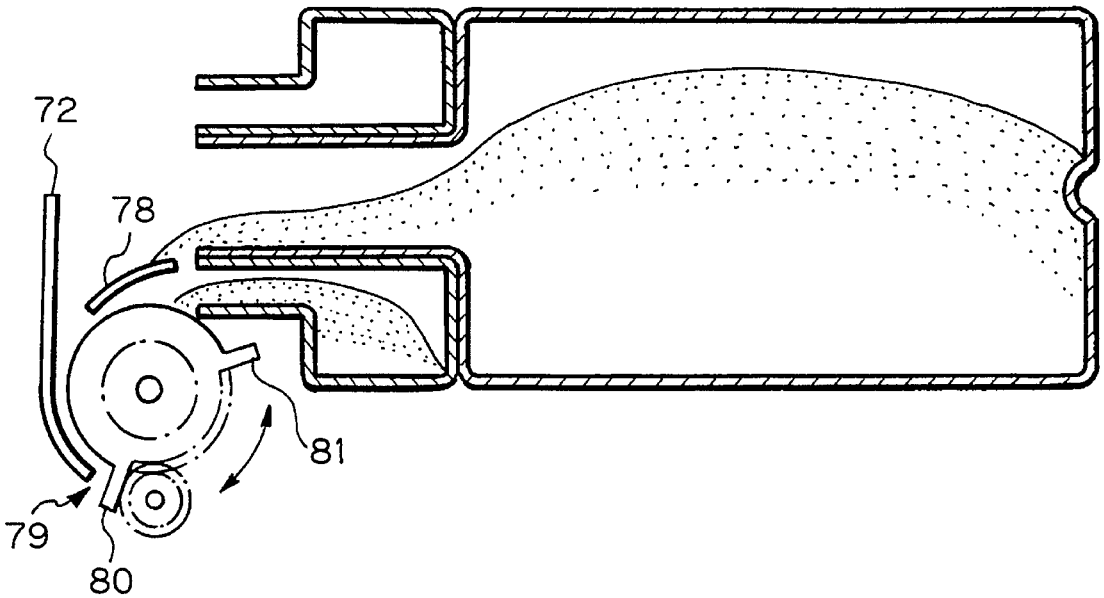
FIG. 14A shows the cartridge of the present invention together with a device for receiving and conveying its contents.
Figure 14B:
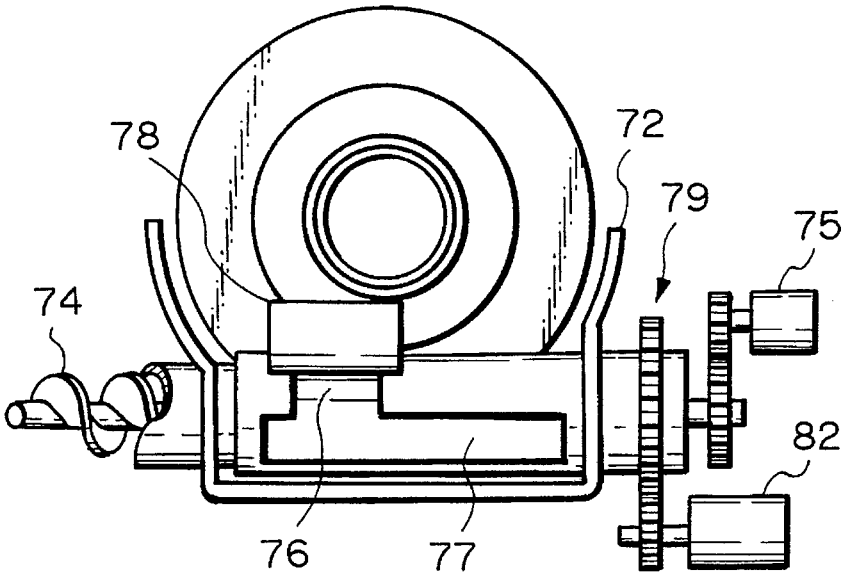
FIG. 14B is a front view associated with FIG. 14A.
Figure 14C:
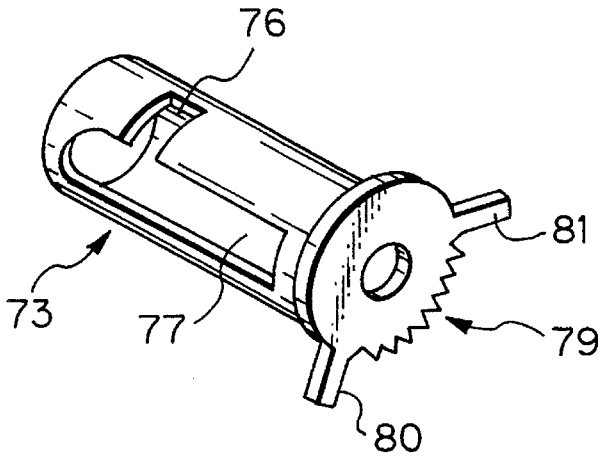
FIG. 14C is an external perspective view of a pipe included in the device of FIG. 14A.

FIGS. 14A–14C show a member for conveying the developer and toner and improved by taking account of the above situation. As shown, a casing 72 extends over the entire width of the open portion of the cartridge. A receptacle 73 is received in the casing 72. A conveyor screw 74 is received in the receptacle 73 and driven by a motor 75 via a gearing. As shown in FIG. 14C, the receptacle 73 is formed with a developer inlet 76 and a developer/toner inlet 77 communicated to each other. The developer inlet 76 is so located as to admit the developer dropping from the container 1. The developer/toner inlet 77 is necessary because the precondition with the embodiment is that the developer and toner be sequentially replenished in this order. The inlet 77 may, of course, be replaced with an exclusive inlet assigned to toner; the exclusive inlet will be aligned with the position where the toner drops, and will be located in the same region as the inlet 77. A cover 78 prevents the toner from being mixed with the developer. The cover 78 covers the developer inlet 76 and fully prevents the toner from being mixed with the developer during the replenishment of the developer. In addition, the cover 78 surely guides the developer toward the developer inlet 76. In this configuration, the toner flown out during the replenishment of the developer is temporarily stored in the empty space of the casing 72. This prevents the toner from being mixed with the developer or from smearing the inside of the engine. A switching member 79 is affixed to one end of the receptacle 73. A first stop 80 and a second stop 81 extend out from the edge of the switching member 79. The edge of the switching member 79 is formed with teeth between the stops 80 and 81. A reversible motor 82 drives the switching member 79 via a gear meshing with the teeth of the member 79, so that the inlet 76 or the inlet 77 is selected, as indicated by a double-headed arrow in FIG. 14A.

Figure 15A:
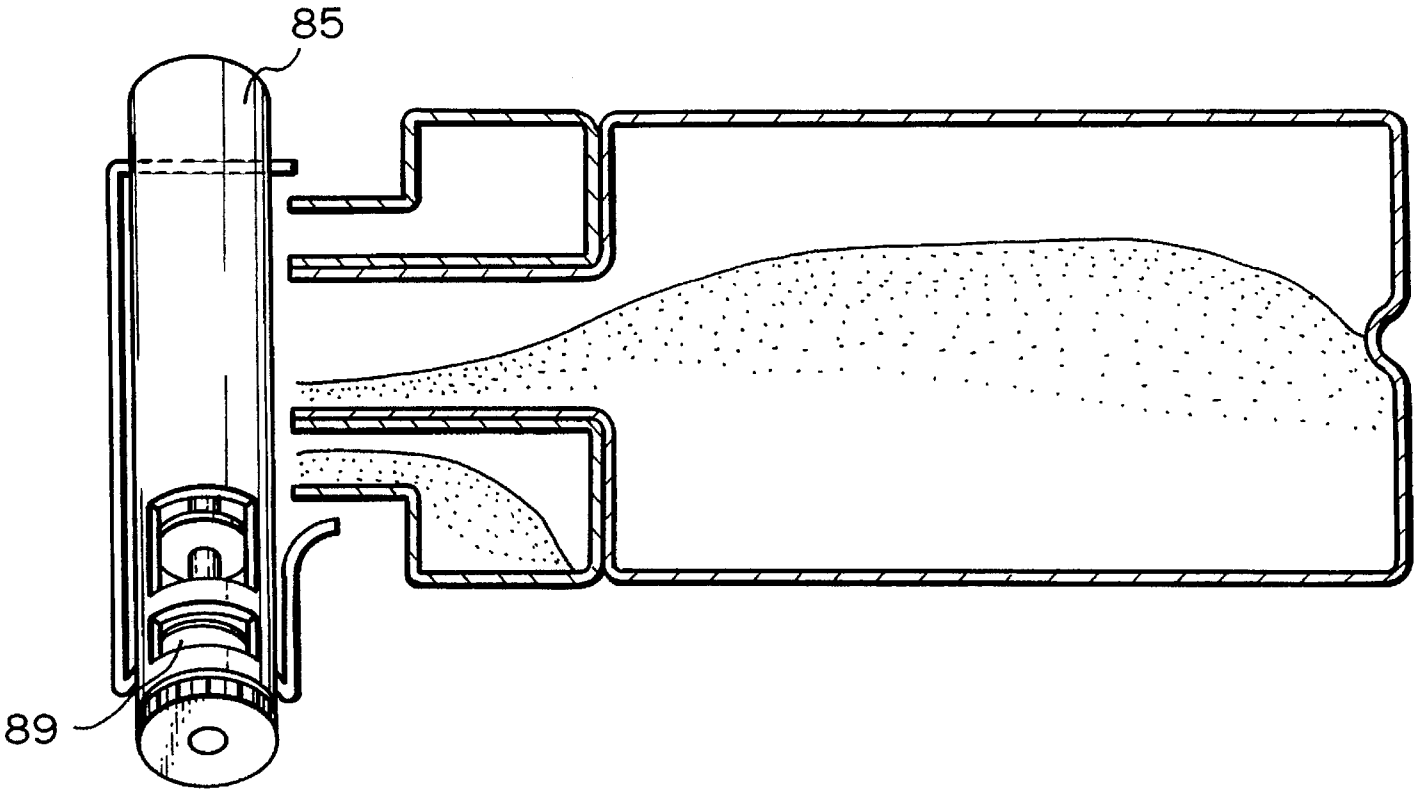
FIG. 15A is a side elevation showing a developer replenishing device implemented by another specific configuration of the receiving and conveying device.
Figure 15B:
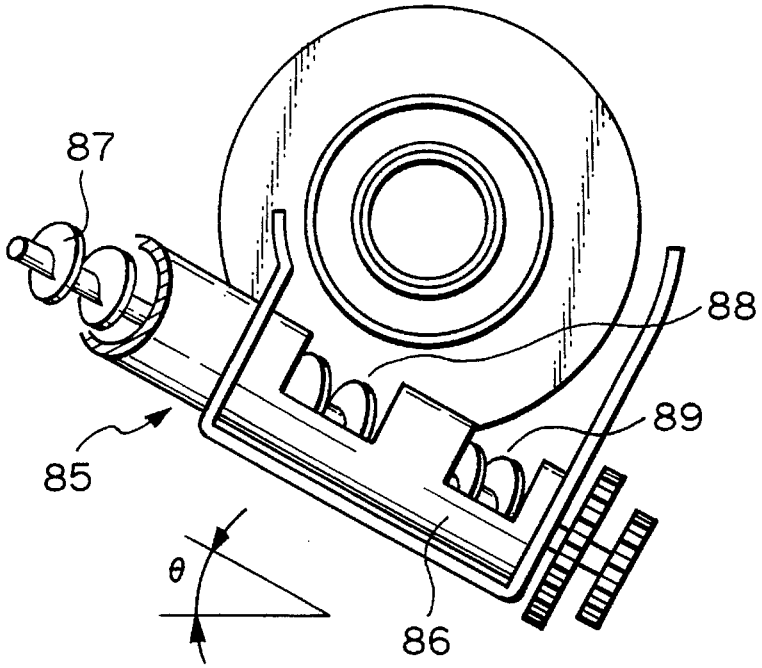
FIG. 15B is a front view associated with FIG. 15A.
Figure 15C:
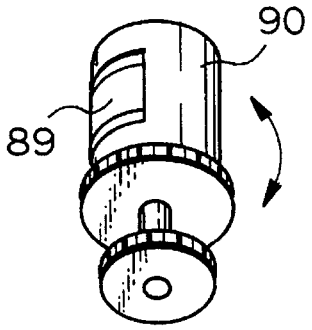
FIG. 15C is an external perspective view of a shutter.
Figure 15D:
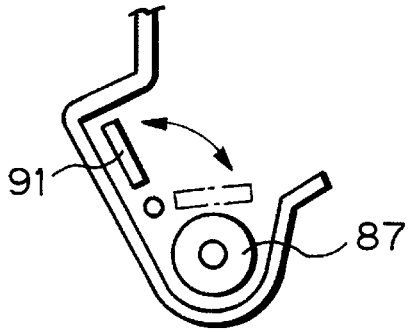
FIG. 15D is a section showing another specific configuration of the shutter.

FIGS. 15A–15D show another specific configuration of the conveying member. As shown in FIG. 15B, the entire conveying member is inclined by an angle θ. The conveying member, like the conveying member of FIGS. 14A–14C, has a casing 85 extending over the entire width of the open portion of the cartridge, a receptacle 86 mounted on the casing 85, and a screw 87 received in the receptacle 86. The screw 87 is driven by a motor, not shown, via a gearing. A developer inlet 88 and a toner inlet 89 are formed in the receptacle 86 and respectively aligned with the positions where the developer and the toner drop. However, the inlet 88 may be positioned slightly at the downstream side, i.e., at the left-hand side as viewed in FIG. 15B, while the inlet 89 may be positioned slightly at the upstream side or right-hand side. In such a position, the inlet 88 surely obviates the mixture of the developer and toner on the basis of the previously mentioned difference in radial dimension between the openings of the containers 1 and 2. Preferably, a member corresponding to the cover 78 shown in FIGS. 14A–14C may be combined with the inlet 88. The above positional deviation of the inlet 89 is allowable because the toner enters the receptacle 86 in due course of time due to the inclination of the entire conveying member. A shutter 90 is positioned to overlap the inlet 89. As shown in FIG. 15C, the shutter 90 closes the inlet 89 during the course of replenishment of the developer. The shutter 90 is driven in the same manner as the switching member 79 shown in FIGS. 14A–14C. FIG. 15D shows an alternative shutter 91 which is pivotable for selectively closing the inlet 89.

Figure 16A:
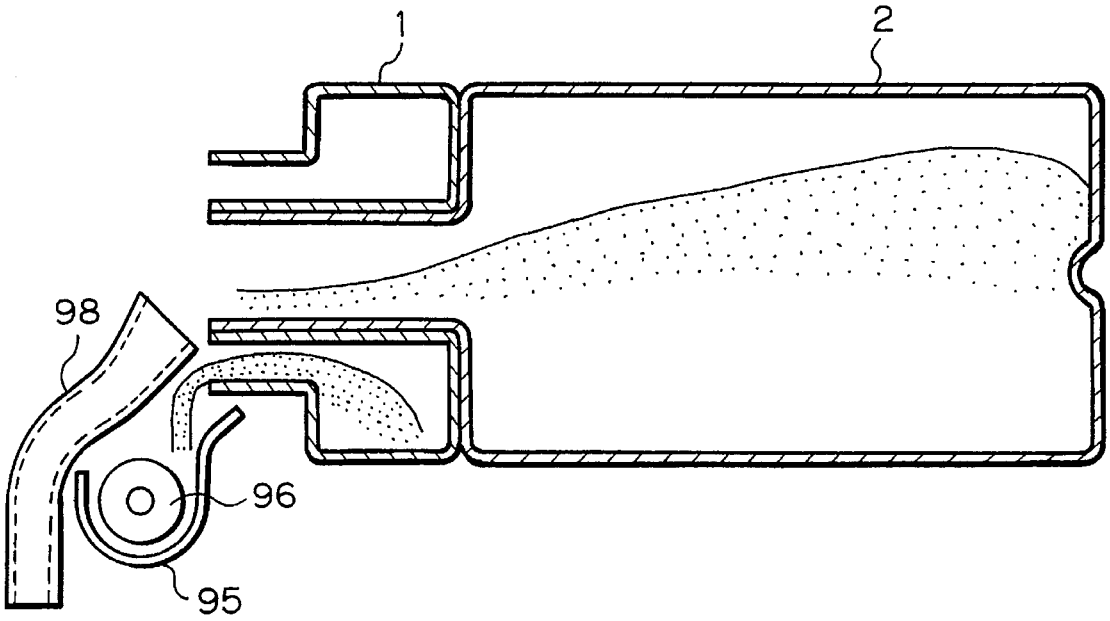
FIG. 16A is a sectional side elevation showing the cartridge together with another specific configuration of the receiving and conveying device.
Figure 16B:
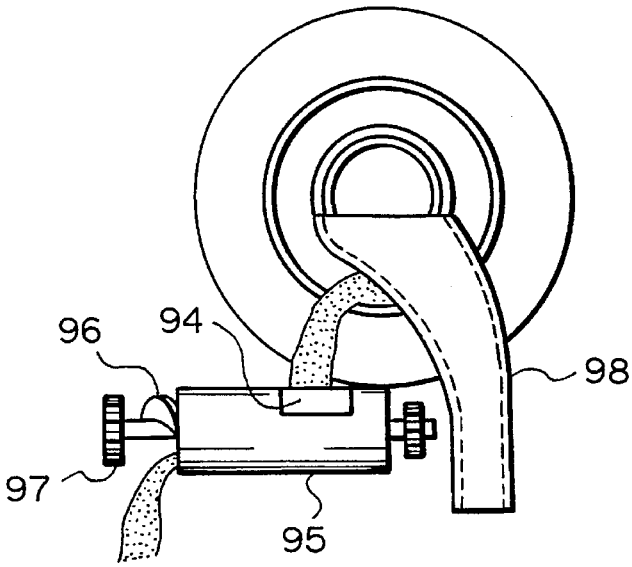
FIG. 16B is a front view associated with FIG. 16A.

Still another specific configuration of the conveying member will be described with reference to FIGS. 16A and 16B. As shown, a member for receiving the developer from the container 1 is made up of a pipe 95, a screw 96 accommodated in the pipe 95, bearings 97, etc. The pipe 95 is formed with an opening 94 aligned with the position where the developer drops from the container 1. This member conveys the developer to a predetermined position for replenishment and defined in the developing unit 54. On the other hand, a member for receiving the toner from the container 2 is implemented by a hopper-like guide 98 open at a position corresponding to the opening of the container 2, and a shutter, not shown, mounted on the intermediate portion of the guide 98. In this specific configuration, the toner may be brought to a replenishing position different from the position assigned to the developer due to its own weight. Although the toner may flow out of the container 2 during the course of replenishment of the developer, the former is prevented from being mixed with the latter because the members for receiving them are independent of each other. In addition, while the developer is replenished, the shutter mounted on the guide 98 retains the toner within the guide 98. This allows the toner concentration in the developing device to be adequately controlled.

Referring again to FIG. 1, the developer or the toner replenished into the developing unit 54 drops onto a first agitator 131 located beneath the inlet 30 and implemented by a screw. The agitator 131 conveys the developer or the toner from the front to the rear, as seen in the direction perpendicular to the sheet surface of FIG. 1. A second agitator or screw 132 conveys the developer or the toner from the rear to the front, as seen in the above direction. The agitators 131 and 132 cooperate to uniformly mix the incoming toner or developer with the developer existing in the developing unit 54. The resulting mixture is fed to the drum 53 via a developing sleeve 133, thereby developing a latent image formed on the drum 53.

The exhaust device 21 is positioned at the opposite side to the supply device 20, i.e., at the rear of the developing device 54 in the above direction. When the level of the developer in the developing device 54 rises due to the replenishment, the exhaust device 21 discharges the part of the developer overflowing the developing unit 54. The exhaust device 21 has a pipe for conveyance and a screw disposed in the pipe. The developer overflown the unit 54 via an outlet 135 is conveyed to the cartridge 10 by the device 21 via the hopper-like collection guide 36. Specifically, the developer from the outlet 135 is conveyed upward by the device 21 and then caused to slide downward along the guide 36 into the cartridge 10 due to its own weight. The developer is, therefore, surely and easily collected in the cartridge 10. The guide 36 is mounted on a vertical rotary shaft 137 and is retracted, when the lid 15 is pushed and pulled, away from the movable range of the lid 15.

The replenishment and collection of the developer and toner between the cartridge 10 and the developing unit 54 is effected as occasion arises. If desired, an arrangement may be made such that the developer in the developing device 54 forms a constant circulating flow, and the fresh developer and toner are introduced into the circulating flow.

With the above sequence of replenishing and collecting steps, the embodiment surely and automatically replaces the developer while collecting the used developer in the cartridge despite its simple drive arrangements. A conventional system dealing with a two-ingredient developer and adopting a premixing scheme for the automatic replacement of the developer is not practicable without resorting to an exclusive developer whose toner concentration is high. By contrast, with the above embodiment, it is possible to effect the automatic replacement of the developer without increasing the number of supplies, i.e., only if a common developer and common toner are used.

Figure 17A:
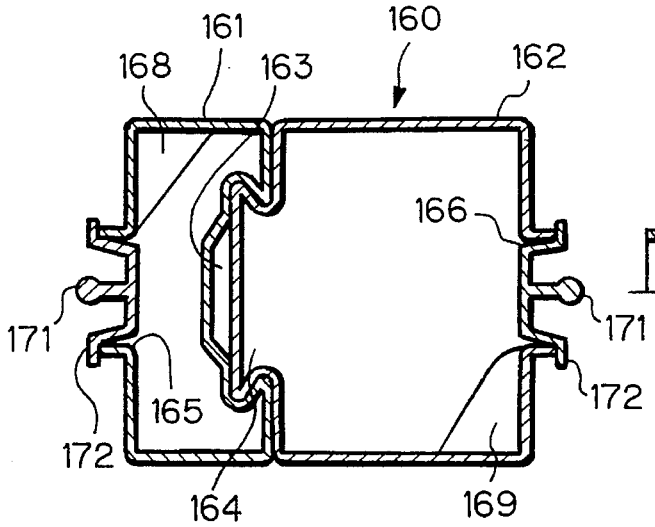
FIG. 17A is a section showing an alternative embodiment of the present invention.

Referring to FIG. 17A, an alternative embodiment of the present invention is shown. As shown, a cartridge 160 has a hollow cylindrical first container 161 storing a developer, and a hollow cylindrical second container 162 coaxial with the container 161 and storing toner. The containers 161 and are mated with each other at their bottoms, as illustrated. Specifically, the containers 161 and 162 respectively have a recess 163 and a projection 164 mating with each other, although the recess 163 and projection 164 may be replaced with each other.

In the assembled condition, the containers 161 and 162 respectively have openings 165 and 166 at axially opposite sides to each other. As in the previous embodiment, a spiral ridge is formed on the inner periphery of each of the containers 161 and 162, although not shown specifically. When the cartridge 160 is rotated in one direction, the developer, for example, stored in the container 161 is driven toward the opening 165 while the toner in the container 162 is driven away from the opening 166. This relation is reversed when the cartridge 160 is rotated in the other direction. Guide walls 168 and 169 respectively adjoin the openings 165 and 166, and each is configured to match the flow of the developer or the toner caused by the spiral ridge. Two lids 172 respectively plug the openings 165 and 166, and each has a thumb piece 171. If the openings 165 and 166 are provided with the same diameter, the lids 172 can be provided with the same configuration, contributing to the reduction of cost.

Figure 17D:
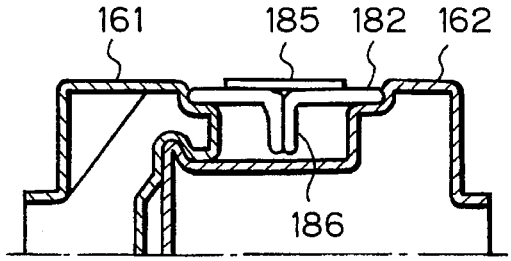
FIGS. 17B, 17C, and 17D each shows a particular modification of containers included in the embodiment of FIG. 17A.
Figure 17E:
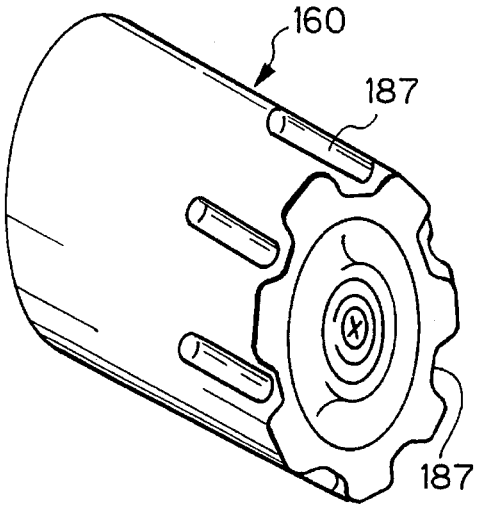
FIG. 17E is an external perspective view showing a modified configuration of the outer periphery of the cartridge.
Figure 17B:
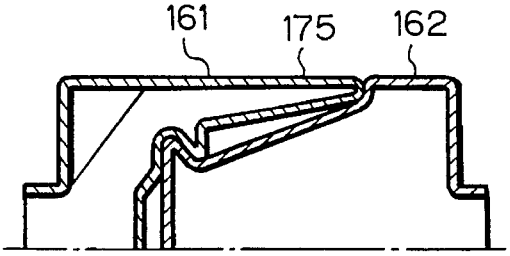

As shown in FIG. 17B, the container 161 may be provided with an annular extension 175 at its rear end. The extension 175 will smoothly connect the container 161 to the container 162 and will thereby obviate the drawbacks previously stated with reference to FIG. 12B.

Figure 17C:
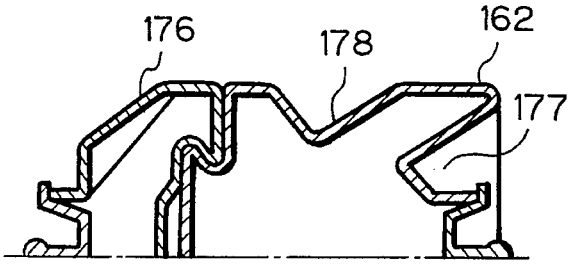

Because the lids 172 plugging the openings 165 and 166 are identical in configuration, some implementation should preferably be provided for protecting the cartridge 160 from misorientation. For example, as shown in FIG. 17C, the containers 161 and 162 may be respectively formed with a chamfer 176 adjoining the opening 165, and a recess 177 adjoining the opening 166. The crux is that the containers 161 and 162 should preferably be different in configuration from each other. If desired, one of the containers 161 and 162 greater in capacity than the other (container 162 in the embodiment) may be formed with a recess 178 along its circumference to allow the operator to surely hold it.

Further, as shown in FIG. 17D, the gap between the containers 161 and 162 may be closed by a spacer 182, as stated earlier with reference to FIG. 12C. The spacer 82 is engaged with the shoulders of the containers 161 and 162 and connect them to each other smoothly. Again, the spacer 182 may be provided with a label 185 and a rib 186, if desired.

Figure 17F:
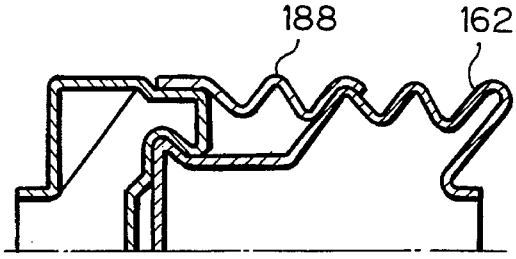
FIG. 17F is a section showing another modified configuration of the outer periphery of the cartridge.

In addition, as shown in FIG. 17E, a plurality of recesses 187 may be distributed on the end portion of the cartridge 160 in order to facilitate the handling of the cartridge 160. As shown in FIG. 17F, projections and recesses may be formed in the circumferential wall of the cartridge 160 over a substantial axial dimension. This also facilitates the handling of the cartridge 160.

In summary, it will be seen that a cartridge of the present invention has various unprecedented advantages as enumerated below.

(1) The cartridge is made up of two containers each storing a content of particular kind. One of the containers is coaxially fitted in a bore formed at the center of the other container by an annular portion. The cartridge, therefore, occupies a minimum of space. In addition, because the openings of the two containers are positioned at the same side of the cartridge and concentric with each other, a drive arrangement for supplying the contents is simple.

(2) Spiral ridges are respectively formed on the inner peripheries of the containers and inclined in opposite directions to each other. Hence, by selectively rotating the cartridge in either direction, the two different contents can be supplied independently of each other. This further enhances the above advantages (1).

(3) A single lid closes both of the openings of the two containers, and the depths to which the lid protrudes into the openings are different by a predetermined amount. Hence, the lid is capable of uncovering one of the openings earlier than the other.

(4) The two containers have the same diameter and mate with each other at their bottoms where a recess and a projection are respectively formed. Coaxial openings are respectively formed through the other ends of the containers. Spiral ridges are respectively formed on the inner peripheries of the containers and inclined in the same direction. This kind of configuration is desirable from the space saving standpoint and allows the two different contents to be supplied independently of each other if the cartridge is selectively rotated in either direction.

Furthermore, a two-ingredient developer replenishing device of the present invention has the following advantages.

(5) The device has a cartridge made up of two containers each storing a content of particular kind. One of the containers is coaxially fitted in a bore formed at the center of the other container by an annular portion. The openings of the two containers are positioned at the same side of the cartridge and concentric with each other. A single supply device guides and conveys both of the contents to be discharged from the containers to a developing unit. A collection device collects substances overflowing the developing unit to at least one of the two containers. The replenishing device is, therefore, space and cost saving, and practicable with simple and sure supply and collection mechanisms. Because the openings of the cartridge are positioned at the same side when the cartridge is laid sideways, the device efficiently uses the space of an image forming apparatus in the widthwise direction. The single supply device successfully reduces the number of parts, saves space, and even allows the different contents to be mixed and agitated before they are fed to the developing unit.

(6) The cartridge of the kind described in the above item (5) is combined with a conveying member having inlets for respectively receiving the two contents at different positions. This simplifies a drive arrangement for replenishment and saves space while surely separating the two contents from each other.

(7) The cartridge has a single lid in addition to the two containers. The lid closes the openings of the containers and protrudes into each of the containers to a particular depth. A check covers and uncovers the openings of the containers by moving the lid. Specifically, the chuck sequentially uncovers the two openings by pulling the lid in two consecutive steps. Hence, when the content of one container is discharged, the content of the other container is preventing from flowing out.

Various modifications will become possible for those skilled in the art after receiving the teachings of the present disclosure without departing from the scope thereof.

What is claimed is:

1. In a cartridge having two containers constructed into a single assembly and each storing a content of particular kind, one of said containers coaxial with the other container is fitted in a bore formed at a center of said other container by an annular portion, said containers having respective openings positioned at a same side and coaxial with each other.

2. A cartridge as claimed in claim 1, wherein spiral ridges inclined in opposite directions to each other are respectively formed on inner peripheries of said containers.

3. A cartridge as claimed in claim 1, wherein a single lid openably closes said openings of said containers and protrudes into each of said openings to a particular width.

4. A cartridge having a first container and a second container having a same diameter and each storing a content of particular kind, said first container comprising:

a recess formed in a bottom;

a first spiral ridge formed on an inner periphery; and a first opening formed in one end;

said second container comprising:

a projection formed in a bottom and mating with said recess of said first container;

a second spiral ridge formed on an inner periphery and inclined in a same direction as said first spiral ridge; and a second opening formed in one end remote from said one end of said first container and coaxial with said first opening.

5. A cartridge as claimed in claim 4, wherein said content of said first container and said content of said second container comprise a developer and toner, respectively.

6. A device for replenishing a developer into a developing unit, comprising:

a cartridge having two containers constructed into a single assembly and each storing a content of particular kind, one of said containers coaxial with the other container being fitted in a bore formed at a center of said other container by an annular portion, said containers having respective openings positioned at a same side and coaxial with each other;

single supplying means for guiding and conveying each of the contents discharged from said openings of said containers to said developing unit; and collecting means for collecting substances overflowing said developing unit in at least one of said two containers.

7. A device for replenishing a developer into a developing unit, comprising:

a cartridge having two containers constructed into a single assembly and each storing a content of particular kind, one of said containers coaxial with the other container being fitted in a bore formed at a center of said other container by an annular portion, said containers having respective openings positioned at a same side and coaxial with each other;

a conveying member having inlets each for receiving one of the contents discharged from said two containers at a particular position.

8. A device for replenishing a developer into a developing unit, comprising:

a cartridge having two containers constructed into a single assembly and each storing a content of particular kind, one of said containers coaxial with the other container being fitted in a bore formed at a center of said other container by an annular portion, said containers having respective openings positioned at a same side and coaxial with each other; and a chuck member for selectively opening or closing a single lid such that said single lid is pulled out in two consecutive steps in order to uncover said openings of said containers stepwise.

* * * * *